US006746342B1

(12) United States Patent
Hsieh

(10) Patent No.: US 6,746,342 B1
(45) Date of Patent: Jun. 8, 2004

(54) METAL HEAD FOR USE IN A GOLF CLUB

(75) Inventor: Wen-Cheng Hsieh, Kaohsiung Hsien (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 0 days.

(21) Appl. No.: 10/330,048

(22) Filed: Dec. 30, 2002

(51) Int. Cl.[7] ..... A63B 53/04
(52) U.S. Cl. ..... 473/342; 473/345; 473/350
(58) Field of Search ..... 473/342, 324, 473/345, 349, 329, 330, 332, 346, 350

(56) References Cited

U.S. PATENT DOCUMENTS 5,536,006 A * 7/1996 Shieh ..... 473/342
5,564,994 A * 10/1996 Chang ..... 473/342
5,713,800 A * 2/1998 Su ..... 473/342
6,050,904 A * 4/2000 Kuo ..... 473/342

* cited by examiner

*Primary Examiner*—Raleigh W. Chiu
(74) *Attorney, Agent, or Firm*—Bacon & Thomas, PLLC

(57) ABSTRACT

A metal head for use in a golf club includes a main hollow body and a striking plate. The main hollow body has an annular flange extending from a front surface thereof with a plurality of spaced protrusions extending outward from a distal end of the annular flange, and the striking plate has an annular dovetail groove defined in an inner surface thereof for receiving the annular flange and the protrusions. Thus, the main hollow body and the striking plate can be connected securely together by pressing the striking plate against the main hollow body to such an extent that the protrusions are deformed and got stuck in flared corners of the annular groove.

10 Claims, 2 Drawing Sheets

METAL HEAD FOR USE IN A GOLF CLUB

BACKGROUND OF THE INVENTION

1. Field of the Invention

The present invention relates to a metal head for use in a golf club and, more particularly, to such a metal head in which a striking plate and a main hollow body are connected securely together, by means of a plurality of protrusions that extend outward from a flange of the main hollow body and are deformed and got stuck in an annular dovetail groove of the striking plate.

2. Description of Related Art

A metal head, for use in a golf club, is known that includes a main hollow body having an opening for receiving a striking plate at its entrance. In detail, the opening is provided on its sidewalls with a plurality of recesses near the entrance thereof, and the striking plate is provided on its inner surface with a plurality of inclined lips which, when the plate is pressed into the opening of the main body, may be deformed and got stuck in the recesses of the striking plate.

Although the metal head can be assembled quickly and securely, its has been found that the striking plate is much possible to be damaged during the pressing process. Furthermore, the plate is enclosed so that the resulting metal head has only a limited effective area for striking a ball.

OBJECTS OF THE INVENTION

The object of the present invention is to provide a metal head in which a striking plate and a main hollow body are connected securely together, by means of a plurality of protrusions that extend outward from a flange of the main hollow body and are deformed and got stuck in an annular dovetail groove of the striking plate, in order to improve the band-strength for the resulting mental head.

Another object of the present invention is to provide a metal head in which the main hollow body and the striking plate are connected together in the above-mentioned hidden manner, so as to maximize the area where the plate covers the main hollow body and hence to provide the metal head with an enlarged effective area for striking a ball.

Still another object of the present invention is to provide a metal head in which the annular dovetail groove of the striking plate is so shallow that the plate may be made thin enough without weakening the structural strength thereof and, therefore, the total weight of the resulting metal head may be reduced.

SUMMARY OF THE INVENTION

To achieve the aforementioned objects, the present invention provides a metal head including a main hollow body and a striking plate. The main hollow body has an annular flange extending from a front surface thereof with a plurality of spaced protrusions extending outward from a distal end of the annular flange, and the striking plate has an annular dovetail groove defined in an inner surface thereof for receiving the annular flange and the protrusions. Thus, the main hollow body and the striking plate can be securely connected together by pressing the striking plate against the main hollow body to such an extent that the protrusions are deformed and got stuck in flared corners of the annular groove.

Other objects, advantages and novel features of this invention will become more apparent from the following detailed description when taken in conjunction with the accompanying drawings.

DETAILED DESCRIPTION OF THE PREFERRED EMBODIMENT

Figure 1:
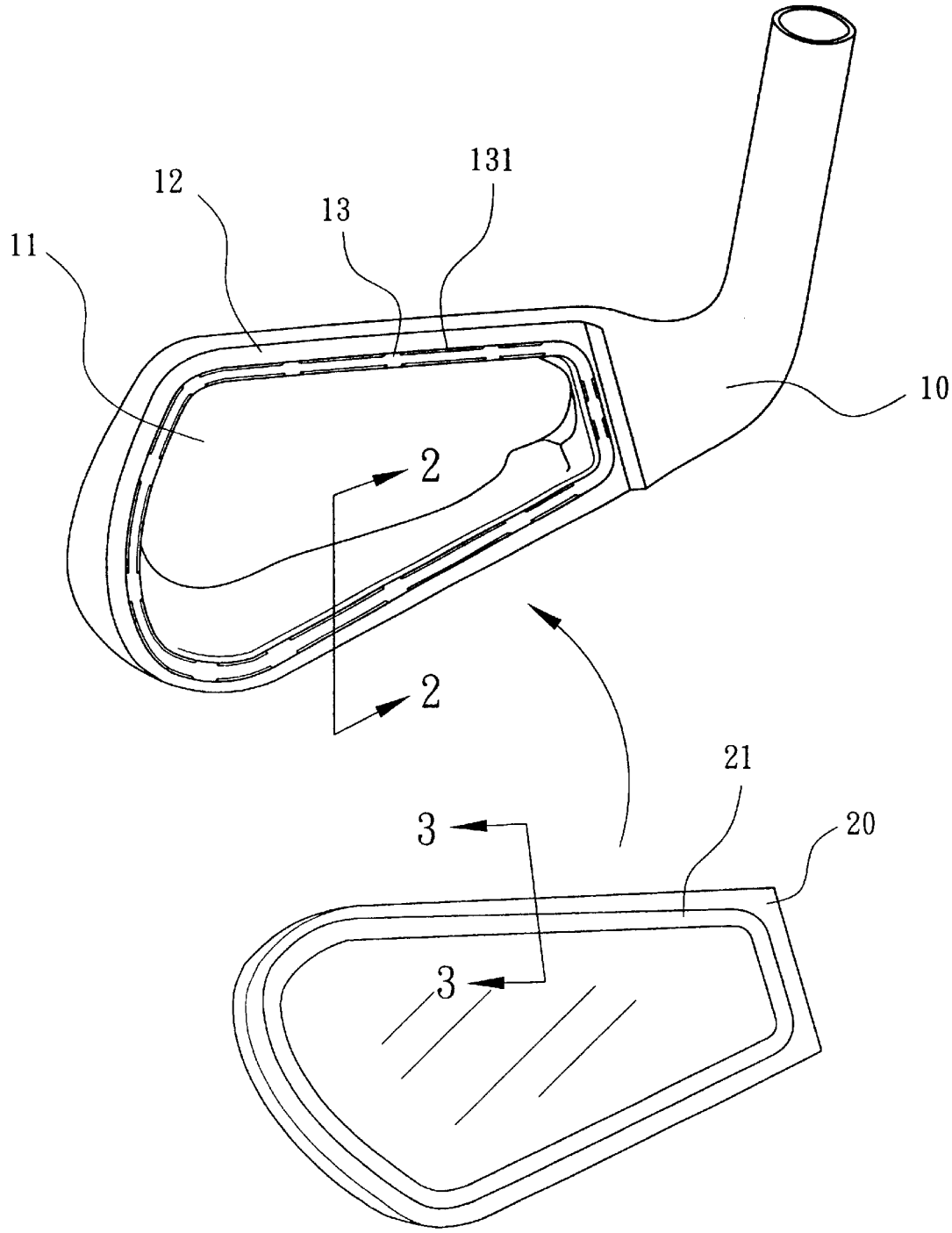
FIG. 1 is an exploded perspective view of a preferred embodiment of a metal heat in accordance with the present invention for use in a golf club.
Figure 2:
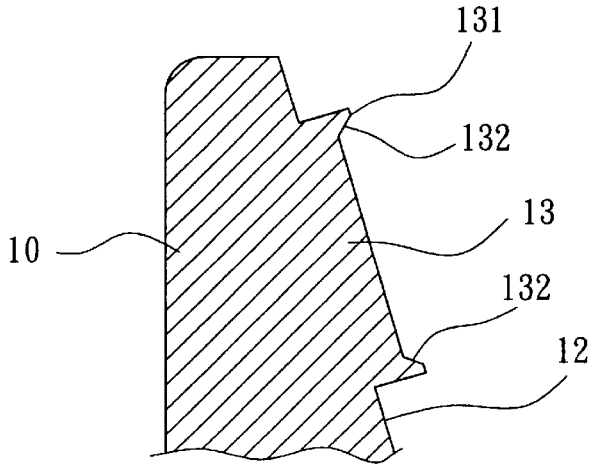
FIG. 2 is an enlarged, broken-out sectional view taken along lines 2—2 in FIG. 1.
Figure 3:
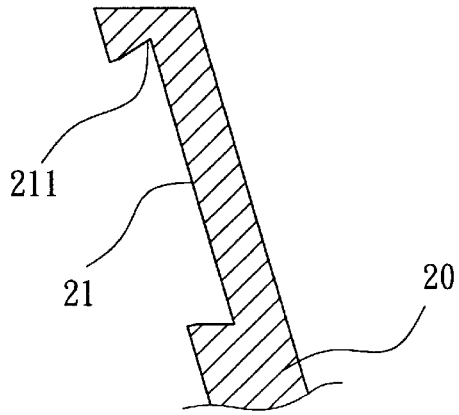
FIG. 3 is an enlarged, broken-out sectional view taken along lines 3—3 in FIG. 1.

The present invention is now to be described hereinafter by way of a preferred embodiment in reference to the drawings. Referring to FIGS. 1 to 3, a metal head in accordance with the present invention for use in a golf club includes a main hollow body 10 and a striking plate 20. The main hollow body 10 has an annular flange 13 extending from a front surface thereof, with a plurality spaced protrusions 131 extending outward from a distal end of the flange 13, as best shown in FIG. 2. The striking plate 20 has an annular groove 21, preferably with a cross section shaped as a dovetail as shown in FIG. 3, defined in an inner surface thereof for receiving the annular flange 13 and the protrusions 131.

In this configuration, the main hollow body 10 and the striking plate 20 can be securely connected together by pressing the striking plate 20 against the main hollow body 10 to such an extent that the protrusions 131 are deformed and got stuck in such annular grooves 23. This increases the bond strength of the inventive head, provides an enlarged effective area for striking a ball and offers a possibility to reduce the thickness of the striking plate 20 without weakening the structural strength of the same plate 20.

Referring to FIGS. 1 and 2, details of the main hollow body 10 are shown. The main body 10, made from a heavy metal or alloy, such as stainless or low-carbon steel or the like, has an opening 11 defined in a center of the front surface thereof and surrounded by a crimp 12 from which the flange 13 extends outward. The flange 13 is preferably formed integrally with the main body 10.

The protrusions 131, which in turn extend outward from the distal end of the flange 13, may include a plurality of first protrusions arranged in an inner imaginary circle and a plurality of second protrusions arranged in an outer imaginary circle equidistant from the inner imaginary circle in normal directions throughout such circles.

These first and second protrusions 131 are preferably spaced equidistantly one from another in the same imaginary circle. Furthermore, these protrusions 131 may preferably be arranged in an aligned relationship with those protrusion in the other imaginary circle, as illustrated in FIG. 1, or, alternatively, may be arranged in a staggered relationship with those protrusions 131 in the other imaginary circle. Referring to FIGS. 1 and 3, details of the striking plate 20 are shown here. The striking plate 20, made from a light metal or alloy, such as stainless or low-carbon steel, titanium alloy or the like, defines the annular dovetail groove 21 in its inner surface. The groove 21 has an entrance slightly wider than the width of the flange 13, and has a depth subsequently equal to or slightly smaller than the height of the flange 13 but slightly smaller than the sum of the heights of the flange 13 and the protrusion 131.

Furthermore, the annular groove 21 is flared inward to form a pair of flared corners 211 at the bottom thereof, which makes the groove 21 to be wider at its bottom than at its entrance. Once the flared corners 211 is filled with the deformed protrusions 131 during the pressing process, the main hollow body 10 and the striking plate 20 are securely connected into a club head.

Such a connection of the main hollow body 10 and the striking plate 20 by the protrusions 131 and the annular dovetail groove 21 can maximize the area where the striking plate 20 covers the main hollow body 10, to be precisely, the effective area for striking a ball with the resulting club head.

Because only the shallow groove 21 is required, the striking plate 20 here can be made as thin as possible under the circumstance that the plate 20 is strong enough for striking the ball, thereby reducing the total weight of the head.

Figure 4:
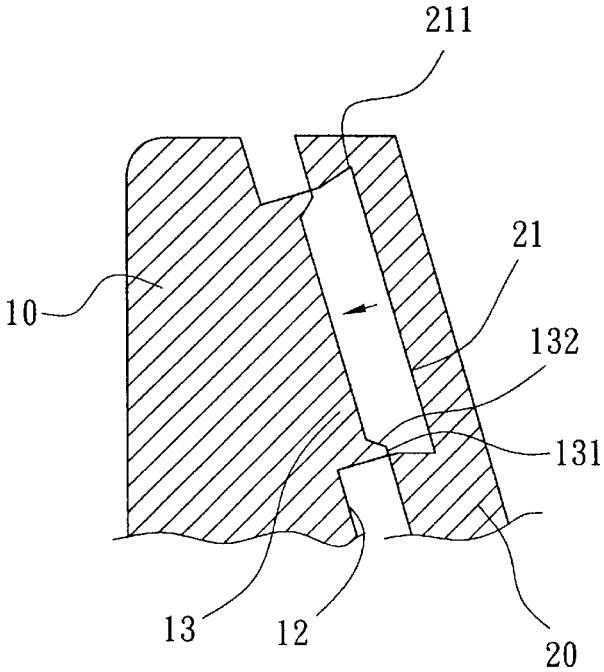
FIG. 4 is a sectional view showing a striking plate to be connected to a main hollow body included in the metal head of FIG. 1.
Figure 5:
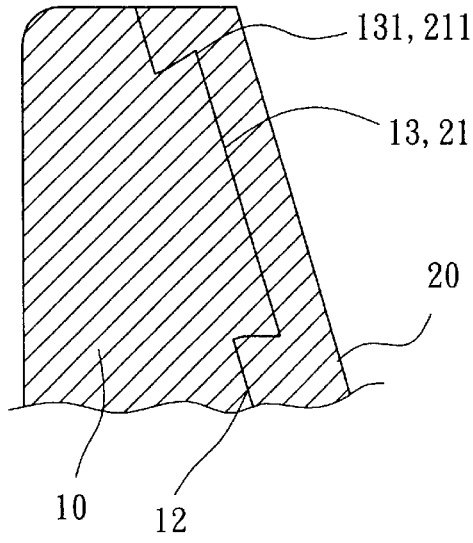
FIG. 5 is a sectional view showing the striking plate connected to the main body.

Referring to FIGS. 4 and 5, the main hollow body 10 and the striking plate 20 are connected together by placing the flange 13 as well as the protrusions 131 into the annular dovetail groove 21 of the plate 21, through the entrance of the groove 21. The striking plate 20 is then pressed towards the main hollow body 10 to such an extent that the protrusions 131 are pressed against the bottom wall of the dovetail groove 21.

With the pressing process continued, these protrusions 131 are gradually deformed and finally fill in the flared corners 211 of the groove 21, as clearly shown in FIG. 5, thereby connecting the main hollow body 10 and striking plate 20 securely together.

In a highly preferred embodiment, each of the protrusions 131 may additionally have an inclined face 132 opposite to the adjacent flared corner 211 to facilitate its deformation and its filling in the same corner 211, and the annular groove 21 may be applied with an adhesive, such as epoxy resin, prior to the connection to contribute to the connection of the main hollow body 10 with the striking plate 20.

Alternatively, the spaced protrusions 131 of the main hollow body 10 may be arranged in a single imaginary circle adjacent to an inner or outer side of the flange 13 and accordingly the annular groove 21 of the striking plate 10 may be flared inward to form a single flared corner 211 in correspondence to the protrusions 131. This configuration of the body 10 and the plate 20 may also allow them to be connected securely together.

From the foregoing, it is apparent that this invention has the advantage of maximizing the effective striking area and providing an improved strength for the striking plate in comparison to the prior art, in which the effective striking area is limited and the striking plate is much possible to be damaged during its pressing process.

While the principles of this invention have been disclosed in connection with a specific embodiment, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A metal head for use in a golf club, comprising:

a main hollow body having an annular flange extending from a front surface thereof, said annular flange being formed with a plurality of spaced protrusions extending outward from a distal end of said annular flange; and a striking plate having an annular groove defined in an inner surface thereof for receiving said annular flange and said protrusions, said annular groove being flared inward to form at least one flared corner at the bottom thereof;

whereby said main hollow body and said striking plate can be connected securely together by pressing said striking plate against said main hollow body to such an extent that said protrusions are deformed and get stuck in said flared corner of said annular groove.

2. The metal head as claimed in claim 1, wherein said annular groove has a cross section shaped as a dovetail.

3. The metal head as claimed in claim 1, wherein each of said protrusions has an inclined face opposite to said flared corner to facilitate its deformation and its getting stuck in said flared corner.

4. The metal head as claimed in claim 1, wherein said annular groove is applied with an adhesive, such as epoxy resin, to contribute to the connection of said main hollow body and said striking plate.

5. The metal head as claimed in claim 1, wherein said spaced protrusions includes a plurality of first protrusions arranged in an inner imaginary circle and a plurality of second protrusions arranged in an outer imaginary circle equidistant from said inner imaginary circle in normal directions throughout said imaginary circles, and wherein said first and second protrusions are spaced equidistantly one from another in the same imaginary circle and are arranged in an aligned relationship with said protrusion in the other imaginary circle.

6. The metal head as claimed in claim 1, wherein said spaced protrusions includes a plurality of first protrusions arranged in an inner imaginary circle and a plurality of second protrusions arranged in an outer imaginary circle equidistant from said inner imaginary circle in normal directions throughout said imaginary circles, and wherein said first and second protrusions are spaced equidistantly one from another in the same imaginary circle and are arranged in a staggered relationship with said protrusion in the other imaginary circle.

7. The metal head as claimed in claim 1, wherein said annular groove has an entrance slightly wider than the width of said flange.

8. The metal head as claimed in claim 1, wherein said annular groove has a depth subsequently equal to the height of said flange but slightly smaller than the sum of the heights of said flange and said protrusion.

9. The metal head as claimed in claim 1, wherein said spaced protrusions are arranged in a single imaginary circle adjacent to an inner side of said flange, and wherein said annular groove is flared inward to form an flared inner corner in correspondence to said protrusions.

10. The metal head as claimed in claim 1, wherein said spaced protrusions are arranged in a single imaginary circle adjacent to an outer side of said flange, and wherein said annular groove is flared inward to form an flared outer corner in correspondence to said protrusions.

* * * * *